US005439154A

United States Patent [19]

Delligatti

[11] Patent Number: 5,439,154

[45] Date of Patent: Aug. 8, 1995

[54] DIAPER BAG

[76] Inventor: Anna Delligatti, 1185 Lewis Ter., West Deptford, N.J. 08096

[21] Appl. No.: 236,120

[22] Filed: May 2, 1994

[51] Int. Cl.[6] ..... A45C 13/30; A45F 3/02; A45F 3/14; B65D 33/14

[52] U.S. Cl. ..... 224/205; 224/202; 224/237; 150/106; 190/1; 383/4

[58] Field of Search ..... 224/202, 205, 236, 237; 150/106, 107, 110, 112, 117; 190/1, 2, 109, 110, 111, 903; 383/4, 38, 39, 40

[56] References Cited

U.S. PATENT DOCUMENTS

| | | | |
|---|---|---|---|
| 4,154,323 | 5/1979 | Sneider | 190/2 |
| 4,566,130 | 1/1986 | Coates | 190/1 |
| 4,852,293 | 8/1989 | Levine et al. | 190/110 |
| 4,886,150 | 12/1989 | Fitzsimmons | 190/2 |
| 4,960,204 | 10/1990 | Young et al. | 190/109 |
| 5,215,172 | 6/1993 | Stevenson | 190/1 |

*Primary Examiner*—Henry J. Recla
*Assistant Examiner*—Timothy L. Maust

[57] ABSTRACT

A diaper bag for holding diapers and accessories used for baby care comprising a plurality of compartments, each compartment having a hollow interior bounded by opposed and spaced first and second side walls with a peripheral edge extended therebetween, each compartment having a sealable opening disposed thereon and extended peripherally across a portion of the peripheral edge with the remainder of the peripheral edge thus creating a pivotal connection between the first and second side walls and enabling the first side wall to be pivoted away from the second side wall when the opening is opened and enabling the first side wall to be pivoted towards the second side wall when the opening is closed, with the compartments coupled side-by-side in sequence with common sidewalls defined between adjacent compartments; a plurality of pockets disposed within the compartments and coupled to the side walls and common sidewalls thereof; and a transportable mechanism coupled to the diaper bag for allowing a user to manually carry the diaper bag from one location to another.

1 Claim, 3 Drawing Sheets

FIG. 1
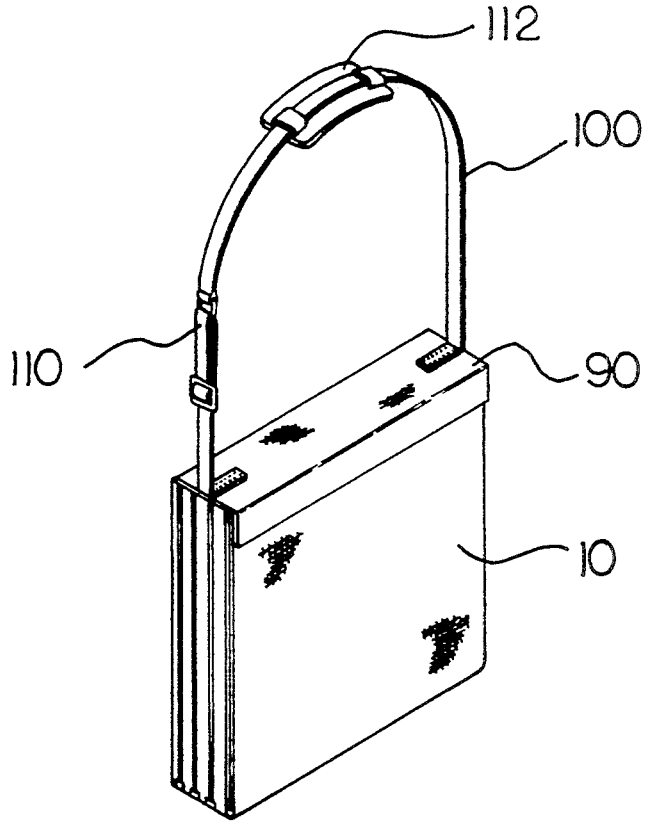
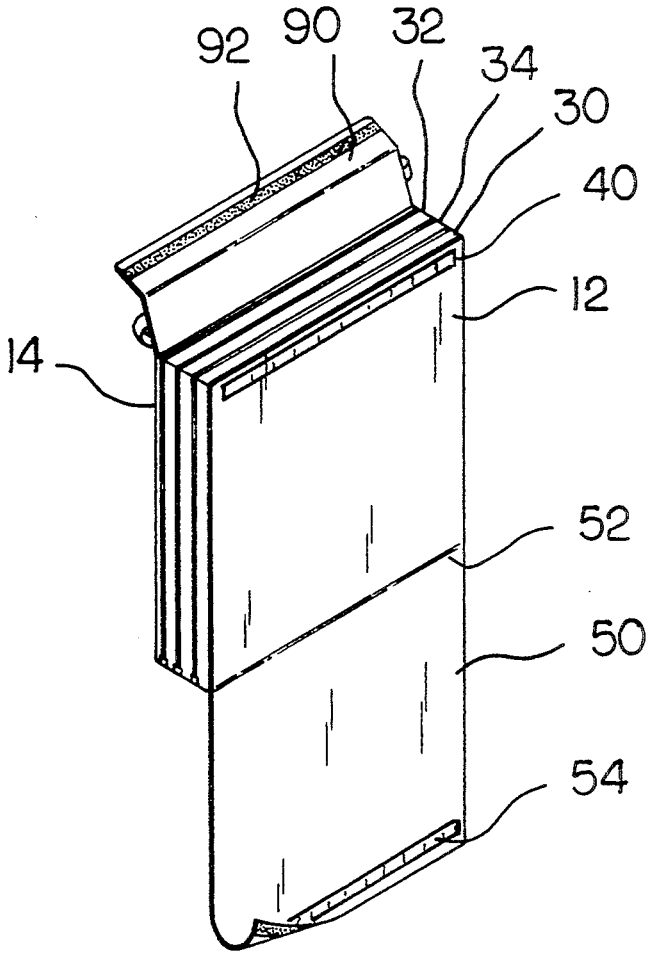
FIG. 2

FIG. 5
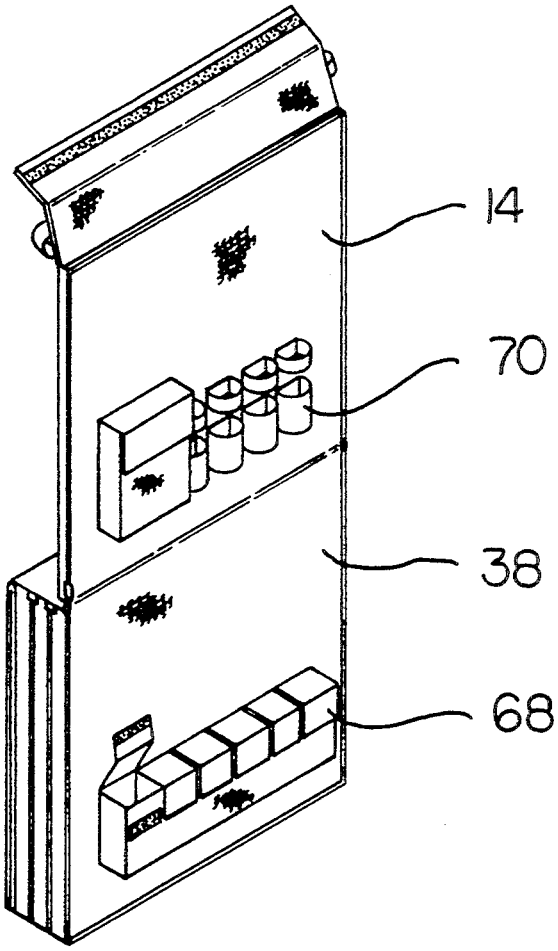
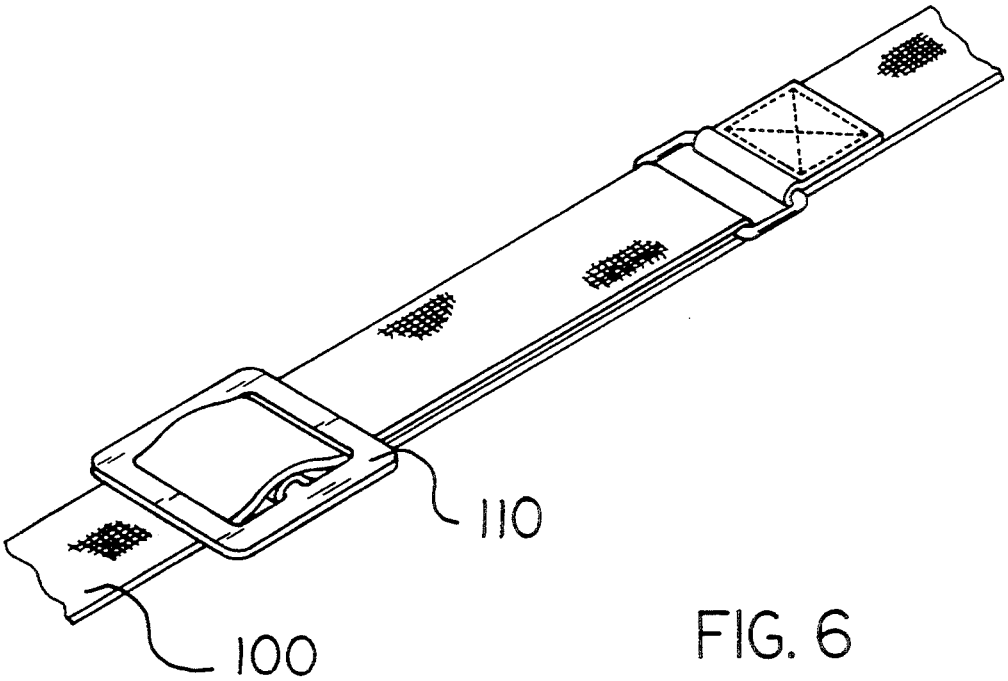
FIG. 6

DIAPER BAG

BACKGROUND OF THE INVENTION

1. Field of the Invention

The present invention relates to a diaper bag and more particularly pertains to holding diapers and accessories used for baby care with a diaper bag.

2. Description of the Prior Art

The use of bags and containers is known in the prior art. More specifically, bags and containers heretofore devised and utilized for the purpose of holding accessories used for baby care are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,566,130 to Coates discloses a combination carrying bag for infant accessories and diapering station. U.S. Pat. No. 4,685,559 to Titus discloses a diaper and infant accessory caddy. U.S. Pat. No. 4,781,277 to Lim discloses a nappy or diaper changing bag. U.S. Pat. No. 5,054,619 to Muckenfuhs discloses a side opening flexible bag with longitudinally oriented carrying handle secured to side panels. U.S. Pat. No. 5,123,467 to Steinberg discloses a diaperbag.

While these devices fulfill their respective, particular objective and requirements, the aforementioned patents do not describe a diaper bag that includes a plurality of compartments each separately pivotable and extendable for allowing quick and easy access to the contents therein.

In this respect, the diaper bag according to the present invention substantially departs from the conventional concepts and designs of the prior art, and in doing so provides an apparatus primarily developed for the purpose of holding diapers and accessories used for baby care.

Therefore, it can be appreciated that there exists a continuing need for a new and improved diaper bag which can be used for holding diapers and accessories used for baby care. In this regard, the present invention substantially fulfills this need.

SUMMARY OF THE INVENTION

In the view of the foregoing disadvantages inherent in the known types of bags and containers now present in the prior art, the present invention provides an improved diaper bag. As such, the general purpose of the present invention, which will be described subsequently in greater detail, is to provide a new and improved diaper bag and method which has all the advantages of the prior art and none of the disadvantages.

To attain this, the present invention essentially comprises, in combination, three essentially rectangular compartments with each compartment having a hollow interior bounded by opposed first and second upwardly extending side walls with opposed peripheral top and bottom edges and opposed peripheral side edges extended therebetween. Each compartment has a zipper disposed thereon and extended peripherally across the side edges and top edge creating a pivotal connection along the bottom edge between the first and second side walls, enabling the first side wall to be pivoted away from the second side wall and extended downwards when the zipper is opened, whereby defining an extended configuration allowing access to the side walls within the compartment, and enabling the first side wall to be pivoted towards the second side wall and retracted upwards when the zipper is closed, whereby defining a retracted configuration preventing access to the side walls within the compartment. The compartments are stacked side-by-side in sequence to define a first compartment, third compartment, and second compartment therebetween with the first side wall of the second compartment coupled side-by-side with the second side wall of the first compartment creating a first common side wall, and the second side wall of the second compartment coupled side-by-side with the first side wall of the third compartment creating a second common side wall and the first side wall of the first compartment having a first pile type fastener positioned remote from the interior and coupled adjacent to the top edge thereof. An essentially rectangular and planar pad is included having an edge pivotally coupled to the first side wall of the first compartment adjacent to the bottom edge and remote from the interior thereof for allowing the pad to be extended for supporting a baby's body when changing diapers thereon, the pad having a second pile type fastener coupled thereto on an edge remote from the pivotal connection with the first compartment, the pad adapted to be foldable in portions and positioned adjacent to the first side wall so as not to extend beyond the periphery thereof when the second pile type fastener is coupled with the first pile type fastener. A first sequence of three rectangular pockets is disposed within the first compartment and coupled to the first side wall thereof with each pocket having an opening with three sealed peripheral edges, the pockets positioned such that when the first compartment is placed in the extended configuration, the opening of the pockets face upwards, and when the first compartment is placed in the retracted configuration, the opening of the pockets face downwards with each pocket adapted for holding baby diapers therein. A second sequence of three rectangular pockets is disposed within the first compartment and coupled to the first common side wall, each pocket having an upwardly extending opening and three sealed peripheral edges with each pocket adapted for holding baby diapers therein. A sealable pouch is disposed within the first compartment and coupled to the first common side wall above the second sequence of pockets with the pouch adapted for holding ointments, baby wipes, safety pins, and other miscellaneous baby care accessories therein. A third sequence of three rectangular pockets is disposed within the second compartment and coupled to the first common side wall with each pocket having an opening and three sealed peripheral edges, the pockets positioned such that when the second compartment is placed in the extended configuration, the openings of the pockets face upwards, and when the second compartment is placed in the retracted configuration, the openings of the pockets face downwards with each pocket adapted to hold a washcloth, towel, burping cloth, and other miscellaneous baby care accessories therein. A fourth sequence of three rectangular pockets is disposed within the second compartment and coupled to the second common side wall, each pocket having an opening and three sealed peripheral edges with each pocket adapted for holding a washcloth, towel, burping cloth, and other miscellaneous baby care accessories therein. A fifth sequence of six sealable and extended rectangular pockets is disposed within the third compartment and coupled to the second common side wall, each pocket having a sealable opening and three sealed peripheral edges, the pockets are positioned such that when the third compartment is placed in the extended configuration, the sealable openings on the pockets face upwards, and when the third compartment is placed in the retracted configuration, the sealable openings on the pockets face downwards with each pocket adapted for holding a baby food container therein. A sixth sequence of five pockets is disposed within the third compartment and coupled to the second side wall thereof, each pocket having an upwardly extending and generally sealable opening with one pocket adapted for holding a container of baby food cereal and the other pockets adapted for holding baby bottles. An essentially rectangular securement flap is included having one edge connected to the top edge of the third compartment near the second side wall thereof and a third pile type fastener connected thereto on edge remote from the pivotal connection with the third compartment with the third pile type fastener adapted to be coupled with the second pile type fastener to place the diaper bag in a transportable configuration. A shoulder strap is included having a first end, second end, and intermediate portion therebetween with the first end and second end offset and coupled to the securement flap, whereby allowing the intermediate portion to be extended upwards to define a loop adapted to be placed over a user's shoulder for carrying the diaper bag in the transportable configuration, the shoulder strap further having adjustable means coupled thereto for allowing the length of the loop to be adjusted and a shoulder pad coupled thereto adapted for cushioning a user's shoulder when the diaper bag is carried.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved diaper bag which has all the advantages of the prior art bags and containers and none of the disadvantages.

It is another object of the present invention to provide a new and improved diaper bag which may be easily and efficiently manufactured and marketed.

It is a further object of the present invention to provide a new and improved diaper bag which is of durable and reliable construction.

An even further object of the present invention is to provide a new and improved diaper bag which is susceptible of a low cost of manufacture with regard to both materials and labor, and which accordingly is then susceptible of low prices of sale to the consuming public, thereby making such a diaper bag economically available to the buying public.

Still yet another object of the present invention is to provide a new and improved diaper bag which provides in the apparatuses and methods of the prior art some of the advantages thereof, while simultaneously overcoming some of the disadvantages normally associated therewith.

Even still another object of the present invention is to provide a new and improved diaper bag for holding diapers and accessories used for baby care.

Lastly, it is an object of the present invention to provide a new and improved diaper bag comprising a plurality of compartments, each compartment having a hollow interior bounded by opposed and spaced first and second side walls with a peripheral edge extended therebetween, each compartment having a sealable opening disposed thereon and extended peripherally across a portion of the peripheral edge with the remainder of the peripheral edge thus creating a pivotal connection between the first and second side walls and enabling the first side wall to be pivoted away from the second side wall when the opening is opened, whereby defining an extended configuration allowing access to the compartment, and enabling the first side wall to be pivoted towards the second side wall when the opening is closed, whereby defining a retracted configuration preventing access to the compartment, with the compartments coupled side-by-side in sequence with common sidewalls defined between adjacent compartments; a plurality pockets disposed within the compartments and coupled to the side walls and common sidewalls thereof, each pocket adapted for holding baby care accessories therein; and transportable means coupled to the diaper bag for allowing a user to manually carry the diaper bag from one location to another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the diaper bag constructed in accordance with the principles of the present invention.

FIG. 2 is a perspective view of the present invention with the changing pad extended and the securement flap opened.

FIG. 5 is a perspective view of the present invention with the third compartment opened.

FIG. 6 is an enlarged view of the adjustable means of the shoulder strap of FIG. 1.

The same reference numerals refer to the same parts through the various Figures.

DESCRIPTION OF THE PREFERRED EMBODIMENT

Figure 3:
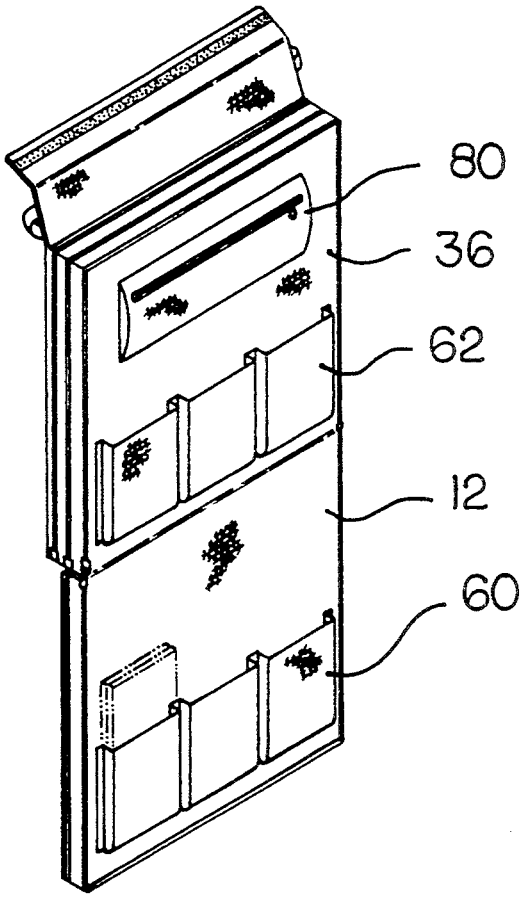
FIG. 3 is a perspective view of the present invention with the first compartment opened.
Figure 4:
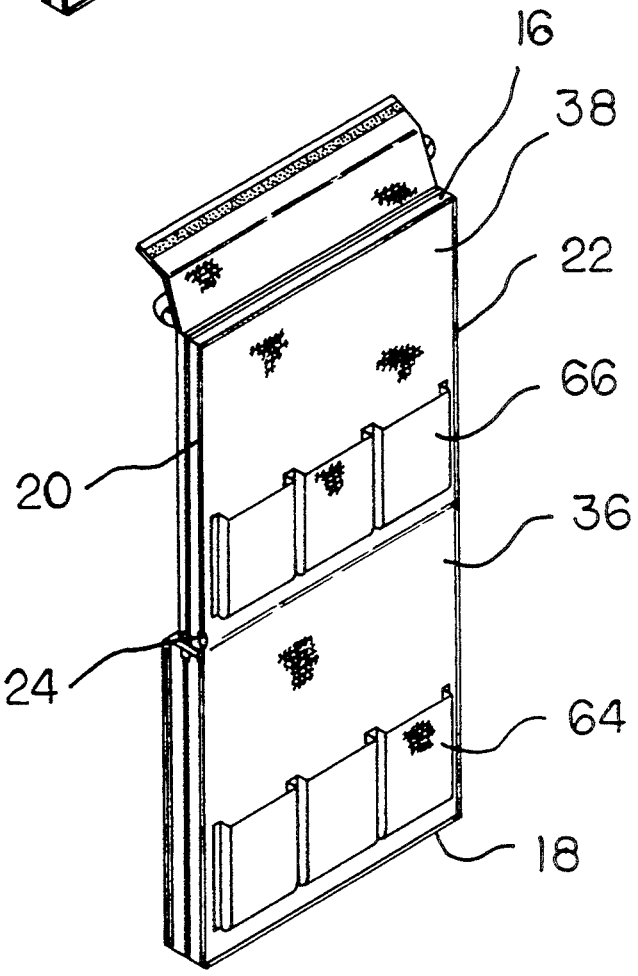
FIG. 4 is a perspective view of the present invention with the second compartment opened.

With reference now to the drawings, and in particular, to FIG. 1 thereof, the preferred embodiment of the new and improved diaper bag embodying the principles and concepts of the present invention and generally designated by the reference number 10 will be described.

Specifically, the present invention includes six major components. The major components are the compartments, pad, pockets, pouch, securement flap, and shoulder strap. These components are interrelated to provide the intended function.

More specifically, it will be noted in the various Figures that the first major component is the compartments. The present invention includes three essentially rectangular compartments. Each compartment has a hollow interior bounded by opposed first and second upwardly extending side walls 12, 14 with opposed peripheral top and bottom edges 16, 18 and opposed peripheral side edges 20, 22 extended therebetween.

Each compartment has a zipper 24 disposed thereon. The zipper is extended peripherally across the side edges 20, 22 and the top edge 16, thus creating a pivotal connection along the bottom edge 18 between the first and second side walls of each compartment. This connection enables the first side wall to be pivoted away from the second side wall and extended downwards when the zipper is opened whereby defining an extended configuration that allows access to the side walls within the compartment. This connection also enables the first side wall to be pivoted towards the second side wall and retracted upwards when the zipper is closed, whereby defining a retracted configuration that prevents access to the side walls within each compartment.

The compartments are stacked side-by-side in sequence to define a first compartment 30, third compartment 32, and a second compartment 34 therebetween. The first side wall of the second compartment 34 is coupled side-by-side with the second wall of the first compartment 30, thus creating a first common side wall 36. The second side wall of the second compartment 34 is coupled side-by-side with the first side wall of the third compartment 32, thus creating a second common side wall 38. The first side wall 12 of the first compartment 30 has a first pile type fastener 40 positioned remote from the interior of the compartment and coupled adjacent to the top edge thereof.

The second major component is the pad 50. The pad is essentially rectangular and planar in structure. It has an edge 52 pivotally coupled to the first side wall 12 of the first compartment 30 adjacent to the bottom edge 18 and remote from the interior thereof. The pad is adapted to be extended for supporting a baby's body when changing diapers thereon. The pad has a second pile type fastener 54 coupled thereto on an edge remote from the pivotal connection with the first compartment 30. The pad is adapted to be foldable in portions so that it may be positioned adjacent to the first side wall yet not extend beyond the periphery thereof when the second pile type fastener is coupled with the first pile type fastener 40.

The third major component is the pockets. The pockets are divided into six sequences. These sequences are interrelated to provide the intended function.

A first sequence 60 of three rectangular pockets is disposed within the first compartment 30 and coupled to the first side wall 12 thereof. Each pocket has an opening with three sealed peripheral edges. The sequence of pockets is positioned such that when the first compartment is placed in the extended configuration, the openings of the pockets face upwards. When the first compartment is placed in the retracted configuration, the openings of the pockets face downwards. Each pocket within the sequence is adapted for holding baby diapers therein.

A second sequence 62 of three rectangular pockets is disposed within the first compartment 30 and coupled to the first common side wall 36. Each pocket has an upwardly extending opening and three sealed peripheral edges. Each pocket within the sequence is adapted for holding baby diapers therein.

A third sequence 64 of three rectangular pockets is disposed within the second compartment 34 and coupled to the first common side wall 36. Each pocket has an opening with three sealed peripheral edges. The sequence of pockets is positioned such that when the second compartment is placed in the extended configuration, the openings of the pockets face upwards. When the second compartment is placed in the retracted configuration, the openings of the pockets face downwards. Each pocket within the sequence is adapted for holding a washcloth, towel, burping cloth, and other miscellaneous baby care accessories therein.

A fourth sequence 66 of three rectangular pockets is disposed within the second compartment 34 and coupled to the second common side wall 38. Each pocket has an opening and three sealed peripheral edges. Each pocket within the sequence is adapted for holding a washcloth, towel, burping cloth, and other miscellaneous baby care accessories therein.

A fifth sequence 68 of six sealable and extended rectangular pockets is disposed within the third compartment 32 and coupled to the second common side wall 38. Each pocket has a sealable opening and three sealed peripheral edges. The sequence of pockets is positioned such that when the third compartment is placed in the extended configuration, the sealable openings on the pockets face upwards. When the third compartment is placed in the retracted configuration, the sealable openings on the pockets face downwards. Each pocket within the sequence is adapted for holding a baby food container therein.

Lastly, a sixth sequence 70 of five pockets is disposed within the third compartment 32 and coupled to the second side wall 14 thereof. Each pocket has an upwardly extending and generally sealable opening. One pocket of the sequence is adapted for holding a container of baby food cereal. The other pockets of the sequence are adapted for holding baby bottles for feeding.

The fourth major component is the pouch 80. The pouch is sealable and disposed within the first compartment 30. It is coupled to the first common side wall 36 above the second sequence 62 of pockets. The pouch is adapted for holding ointments, baby wipes, safety pins, and other miscellaneous baby care accessories therein.

The fifth major component is the securement flap 90. The securement flap is essentially rectangular in structure. The securement flap has one edge connected to the top edge of the third compartment 32 near the second side wall 14 thereof. A third pile type fastener 92 is connected to the securement strap on an edge remote from the pivotal connection with the third compartment. The third pile type fastener is adapted to be coupled with the second pile type fastener 54 to place the diaper bag in a transportable configuration.

The sixth major component is the shoulder strap 100. The shoulder strap has a first end, second end, and intermediate portion therebetween. The first end and the second end of the strap are offset and coupled to the securement flap 90. This allows the intermediate portion to be extended upwards to define a loop adapted to be placed over a user's shoulder for carrying the diaper bag in the transportable configuration. The shoulder strap further includes adjustable means 110 coupled thereto for allowing the length of the shoulder strap to be adjusted. The shoulder strap also has a shoulder pad 112 coupled thereto. The shoulder pad is adapted for cushioning a user's shoulder when the diaper bag is carried.

In the preferred embodiment, the present invention is 18½ inches wide and 16 inches high. It has a 20 inch drop length shoulder strap for carrying. The changing pad is attached with a velcro pile type fastener to the front of the bag. The changing pad extends to a length of 36 inches.

The first compartment is adapted to hold approximately 10 diapers, with each pocket holding about 2 diapers. Each pocket is about 6 inches wide. The pouch is used for holding miscellaneous baby accessories such as ointment, baby wipes, safety pins, and the like.

The second compartment is adapted to hold two baby outfits and as many baby socks that will fit. The second compartment is also adapted to hold a wash cloth, towel, burping cloth, plus miscellaneous accessories. Each pocket of the second compartment is about 6 inches wide.

The third compartment is adapted to hold 4 baby bottles, 6 baby food jars, plus a box of baby food such as cereal. Each bottle holder extends about 3 inches in height. Each food holder extends about 3 inches in height. The cereal holder extends about 6 inches in height.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A diaper bag for holding diapers and accessories used for baby care comprising, in combination:

three essentially rectangular compartments, each compartment having a hollow interior bounded by opposed first and second upwardly extending side walls with opposed peripheral top and bottom edges and opposed peripheral side edges extended therebetween, each compartment having a zipper disposed thereon and extended peripherally across the side edges and top edge creating a pivotal connection along the bottom edge between the first and second side walls and enabling the first side wall to be pivoted away from the second side wall and extended downwards when the zipper is opened, whereby defining an extended configuration allowing access to the side walls within the compartment, and enabling the first side wall to be pivoted towards the second side wall and retracted upwards when the zipper is closed, whereby defining a retracted configuration preventing access to the side walls within the compartment, with the compartments stacked side-by-side in sequence and defining a first compartment, third compartment, and second compartment therebetween, with the first side wall of the second compartment coupled side-by-side with the second side wall of the first compartment creating a first common side wall, and the second side wall of the second compartment coupled side-by-side with the first side wall of the third compartment creating a second common side wall and the first side wall of the first compartment having a first pile type fastener positioned remote from the interior and coupled adjacent to the top edge thereof;

an essentially rectangular and planar pad having an edge pivotally coupled to the first side wall of the first compartment adjacent to the bottom edge and remote from the interior thereof for allowing the pad to be extended for supporting a baby's body when changing diapers thereon, the pad having a second pile type fastener coupled thereto on an edge remote from the pivotal connection with the first compartment, the pad adapted to be foldable in portions and positioned adjacent to the first side wall so as not to extend beyond the periphery thereof when the second pile type fastener is coupled with the first pile type fastener;

a first sequence of three rectangular pockets disposed within the first compartment and coupled to the first side wall thereof, each pocket having an opening with three sealed peripheral edges, the pockets positioned such that when the first compartment is placed in the extended configuration, the opening of the pockets face upwards, and when the first compartment is placed in the retracted configuration, the opening of the pockets face downwards with each pocket adapted for holding baby diapers therein;

a second sequence of three rectangular pockets disposed within the first compartment and coupled to the first common side wall, each pocket having an upwardly extending opening and three sealed peripheral edges with each pocket adapted for holding baby diapers therein;

a sealable pouch disposed within the first compartment and coupled to the first common side wall above the second sequence of pockets, the pouch adapted for holding ointments, baby wipes, safety pins, and other miscellaneous baby care accessories therein;

a third sequence of three rectangular pockets disposed within the second compartment and coupled to the first common side wall, each pocket having an opening and three sealed peripheral edges, the pockets positioned such that when the second compartment is placed in the extended configuration, the openings of the pockets face upwards, and when the second compartment is placed in the retracted configuration, the openings of the pockets face downwards with each pocket adapted to hold a washcloth, towel, burping cloth, and other miscellaneous baby care accessories therein;

a fourth sequence of three rectangular pockets disposed within the second compartment and coupled to the second common side wall, each pocket having an opening and three sealed peripheral edges with each pocket adapted for holding a washcloth, towel, burping cloth, and other miscellaneous baby care accessories therein;

a fifth sequence of six sealable and extended rectangular pockets disposed within the third compartment and coupled to the second common side wall, each pocket having a sealable opening and three sealed peripheral edges, the pockets positioned such that when the third compartment is placed in the extended configuration, the sealable openings on the pockets face upwards, and when the third compartment is placed in the retracted configuration, the sealable openings on the pockets face downwards with each pocket adapted for holding a baby food container therein;

a sixth sequence of five pockets disposed within the third compartment and coupled to the second side wall thereof, each pocket having an upwardly extending and generally sealable opening, with one pocket adapted for holding a container of baby food cereal and the other pockets adapted for holding baby bottles;

an essentially rectangular securement flap having one edge connected to the top edge of the third compartment near the second side wall thereof and a third pile type fastener connected thereto on edge remote from the pivotal connection with the third compartment, the third pile type fastener adapted to be coupled with the second pile type fastener to place the diaper bag in a transportable configuration; and a shoulder strap having a first end, second end, and intermediate portion therebetween, the first end and second end offset and coupled to the securement flap, whereby allowing the intermediate portion to be extended upwards to define a loop adapted to be placed over a user's shoulder for carrying the diaper bag in the transportable configuration, the shoulder strap further having adjustable means coupled thereto for allowing the length of the shoulder strap to be adjusted and a shoulder pad coupled thereto adapted for cushioning a user's shoulder when the diaper bag is carried.

* * * * *